US008544553B2

(12) United States Patent
Milkovisch et al.

(10) Patent No.: US 8,544,553 B2
(45) Date of Patent: Oct. 1, 2013

(54) SEALING APPARATUS AND METHOD FOR A DOWNHOLE TOOL

(75) Inventors: Mark Milkovisch, Cypress, TX (US); Craig Cumba, Houston, TX (US); Liane Miller, Austin, TX (US); Alejandro Tello, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 494 days.

(21) Appl. No.: 12/761,477

(22) Filed: Apr. 16, 2010

(65) Prior Publication Data

US 2011/0094757 A1 Apr. 28, 2011

Related U.S. Application Data

(60) Provisional application No. 61/169,926, filed on Apr. 16, 2009.

(51) Int. Cl.
*E21B 34/06* (2006.01)

(52) U.S. Cl.
USPC ..... 166/378; 166/242.7; 251/149.6

(58) Field of Classification Search
USPC ..... 166/332.1, 332.5, 378, 242.6, 242.7; 251/149.6
See application file for complete search history.

(56) References Cited

U.S. PATENT DOCUMENTS

| | | | | |
|---|---|---|---|---|
| 2,735,696 | A * | 2/1956 | Omon et al. | 137/614.05 |
| 5,365,972 | A * | 11/1994 | Smith, III | 137/614.04 |
| 6,050,338 | A * | 4/2000 | Watkins | 166/348 |
| 6,213,202 | B1 * | 4/2001 | Read, Jr. | 166/55.1 |
| 6,474,359 | B1 * | 11/2002 | Smith, III | 137/493.9 |
| 6,641,434 | B2 | 11/2003 | Boyle et al. | |
| 7,114,562 | B2 | 10/2006 | Fisseler et al. | |
| 7,543,659 | B2 | 6/2009 | Partouche et al. | |
| 2003/0066978 | A1 * | 4/2003 | Enerson | 251/86 |

* cited by examiner

*Primary Examiner* — Shane Bomar
*Assistant Examiner* — Robert E Fuller
(74) *Attorney, Agent, or Firm* — Cathy Hewitt; John Vereb

(57) ABSTRACT

An apparatus and a method to seal and prevent leakage within a downhole tool are disclosed herein. The apparatus includes a first body portion having a first fluid flow path formed therethrough and a second body portion having a second fluid flow path formed therethrough. The second body portion is movable between a first position and a second position with respect to the first body portion. The apparatus further includes a stopper connected to the second body portion and disposed within the first body portion. When the second body portion is in the first position, the stopper sealingly engages the first fluid flow path, and when the second body portion is in the second position, the stopper sealingly disengages from the first fluid flow path.

14 Claims, 7 Drawing Sheets

SEALING APPARATUS AND METHOD FOR A DOWNHOLE TOOL

CROSS-REFERENCE TO RELATED APPLICATIONS

This application claims benefit of U.S. Provisional Application No. 61/169,926, filed on Apr. 16, 2009, the entire disclosure of which is hereby incorporated herein by reference.

BACKGROUND OF THE DISCLOSURE

Wells are generally drilled into the ground or ocean bed to recover natural deposits of oil and gas, as well as other desirable materials that are trapped in geological formations in the Earth's crust. Wells are typically drilled using a drill bit attached to the lower end of a "drill string." Drilling fluid, or mud, is typically pumped down through the drill string to the drill bit. The drilling fluid lubricates and cools the bit, and may additionally carry drill cuttings from the borehole back to the surface.

In various oil and gas exploration operations, it may be beneficial to have information about the subsurface formations that are penetrated by a borehole. For example, certain formation evaluation schemes include measurement and analysis of the formation pressure and permeability. These measurements may be essential to predicting the production capacity and production lifetime of the subsurface formation. When performing such measurements, downhole tools having electric, mechanic, and/or hydraulic powered devices may be used. To energize downhole tools using hydraulic power, various systems may be used to pump fluid, such as hydraulic fluid. Such pump systems may be controlled to vary output pressures and/or flow rates to meet the needs of particular applications. Pressurized fluid may then be communicated to the hydraulic powered devices in a tool string. Further, in some implementations, pump systems may be used to draw and pump formation fluid from subsurface formations. The pumped formation fluid may consequently be communicated to fluid sensors and/or storages vessels provided in the tool string.

A downhole string (e.g., a drill string, coiled tubing string, slickline string, wireline string, etc.) may include multiple modules, such as multiple components, connected to each other such that the modules are in communication with each other. For example, the modules may be in fluid communication and/or in electrical communication. Thus, the modules may have hydraulic and electrical connections to enable communication therebetween. Accordingly, the downhole string (and components thereof) may be susceptible to contamination when making and breaking module connections to assemble and disassemble the downhole string, such as fluid contamination from the hydraulic connections into the electrical connections.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
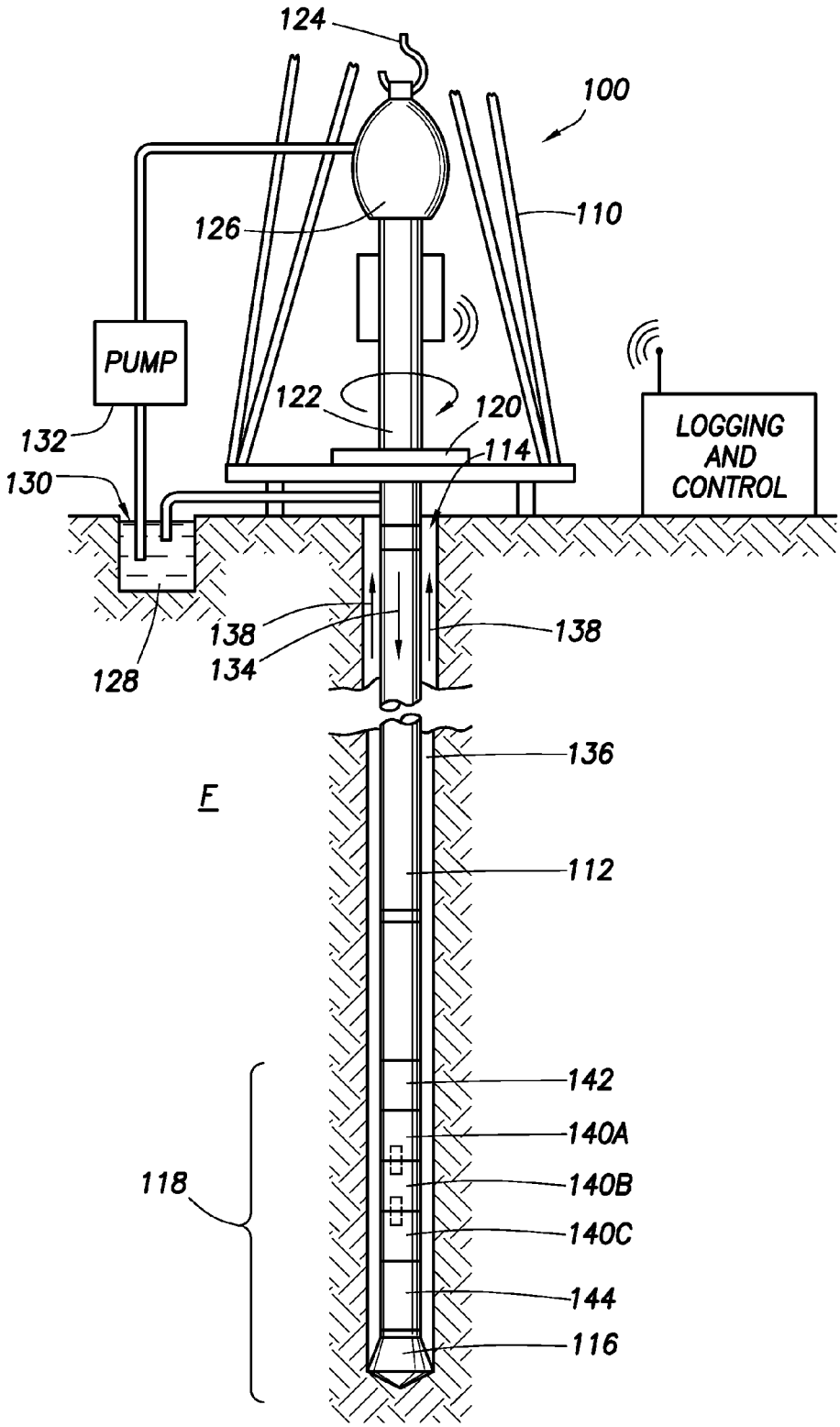
FIG. 1 shows a schematic view of a wellsite having an apparatus in accordance with one or more embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring now to FIG. 1, a schematic view of a wellsite 100 having a drilling rig 110 with a drill string 112 suspended therefrom in accordance with one or more embodiments of the present disclosure is shown. The wellsite 100 shown, or one similar thereto, may be used within onshore and/or offshore locations. In this embodiment, a borehole 114 may be formed within a subsurface formation F, such as by using rotary drilling, or any other method known in the art. As such, one or more embodiments in accordance with the present disclosure may be used within a wellsite, similar to the one as shown in FIG. 1 (discussed more below). Further, those having ordinary skill in the art will appreciate that the present disclosure may be used within other wellsites or drilling operations, such as within a directional drilling application, without departing from the scope of the present disclosure.

Continuing with FIG. 1, the drill string 112 may suspend from the drilling rig 110 into the borehole 114. The drill string 112 may include a bottom hole assembly 118 and a drill bit 116, in which the drill bit 116 may be disposed at an end of the drill string 112. The surface of the wellsite 100 may have the drilling rig 110 positioned over the borehole 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

Further, an upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used in accordance with one or more embodiments without departing from the scope of the present disclosure. In such a top-drive system, the hook 124, swivel 126, and kelly 122 are replaced by a drive motor (electric or hydraulic) that may apply rotary torque and axial load directly to drill string 112.

The wellsite 100 may further include drilling fluid 128 (also known as drilling "mud") stored in a pit 130. The pit 130 may be formed adjacent to the wellsite 100, as shown, in which a pump 132 may be used to pump the drilling fluid 128 into the borehole 114. In this embodiment, the pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, in this embodiment, the drilling fluid 128 may exit the drill string 112 through one or more ports formed within the drill bit 116.

As such, the drilling fluid 128 may flow back upwardly through the borehole 114, such as through an annulus 136 formed between the exterior of the drill string 112 and the interior of the borehole 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the borehole 114) back to the surface of the wellsite 100. As such, this drilling fluid 128 may be filtered and cleaned and/or returned back to the pit 130 for recirculation within the borehole 114.

Though not shown in this embodiment, the drill string 112 may further include one or more stabilizing collars. A stabilizing collar may be disposed within and/or connected to the drill string 112, in which the stabilizing collar may be used to engage and apply a force against the wall of the borehole 114. This may enable the stabilizing collar to prevent the drill string 112 from deviating from the desired direction for the borehole 114. For example, during drilling, the drill string 112 may "wobble" within the borehole 114, thereby enabling the drill string 112 to deviate from the desired direction of the borehole 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components included therein, such as components to measure, process, and store information. Further, the bottom hole assembly 118 may include components to communicate and relay information to the surface of the wellsite.

As such, in this embodiment shown in FIG. 1, the bottom hole assembly 118 may include one or more logging-while-drilling ("LWD") tools 140A-140C and/or one or more measuring-while-drilling ("MWD") tools 142. Further, the bottom hole assembly 118 may also include a steering-while-drilling system (e.g., a rotary-steerable system) and motor 144, in which the rotary-steerable system and motor 144 may be coupled to the drill bit 116.

The LWD tools 140A, 140B and 140C shown in FIG. 1 may include a thick-walled housing, commonly referred to as a drill collar, and may include one or more of a number of logging tools known in the art. Thus, the LWD tools 140A, 140B, and 140C may be capable of measuring, processing, and/or storing information therein, as well as capabilities for communicating with equipment disposed at the surface of the wellsite 100.

Further, the MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. As such, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

In the example shown in FIG. 1, two or more of the LWD tools 140A, 140B, and 140C may be fluidly and electrically coupled, for example as shown in U.S. Pat. No. 7,543,659, incorporated herein by reference. An apparatus according to one or more embodiments of the present disclosure may be used within the tool string 118 to prevent leakage of fluid between the LWD tools 140A and 140B, and/or between the LWD tools 140B and 140C, such as when connecting and disconnecting the LWD tools to and from each other before lowering the tools in the borehole 114 and/or after pulling the tools out of the borehole 114.

Figure 2:
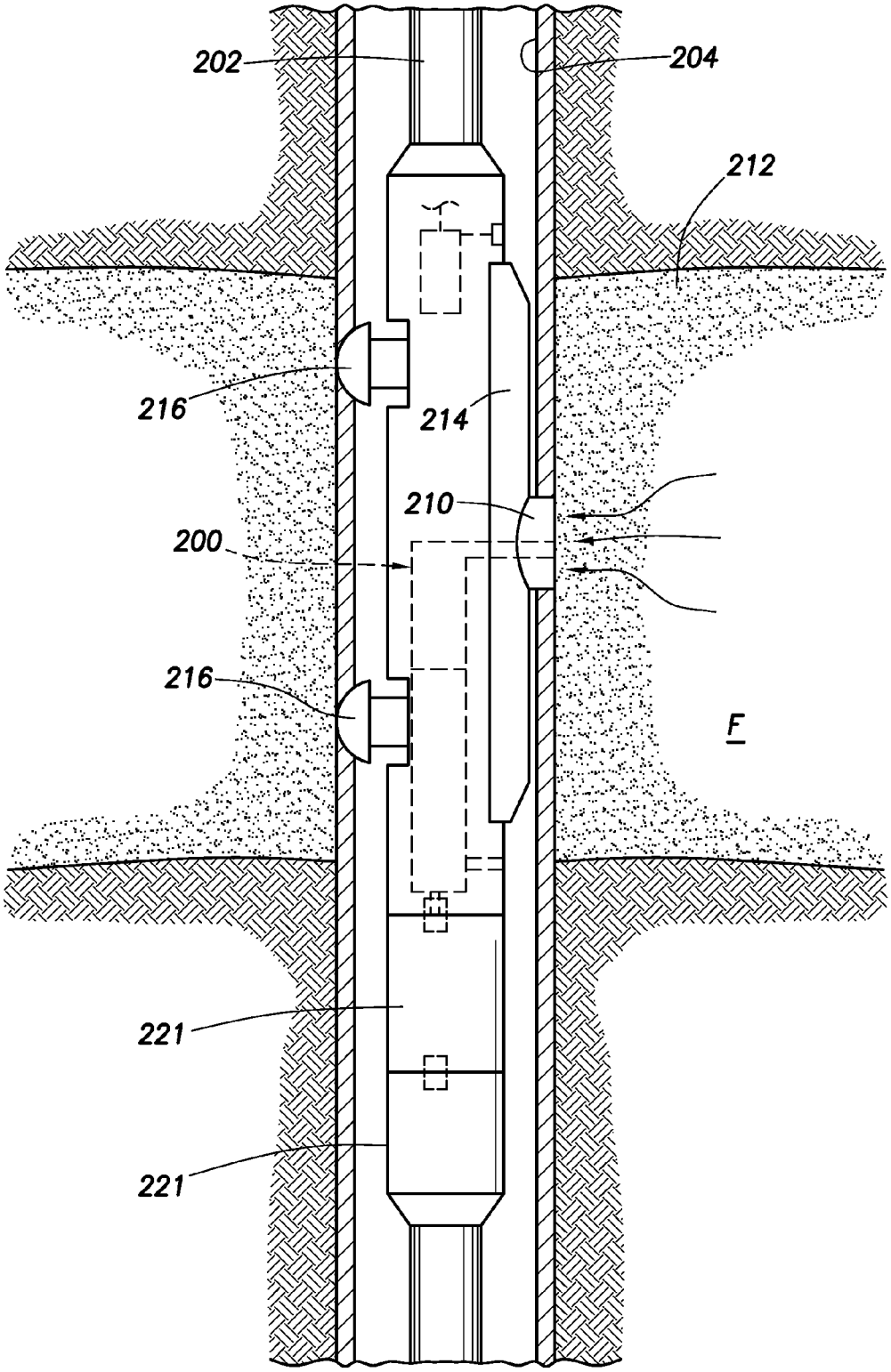
FIG. 2 shows a schematic view of a borehole having an apparatus in accordance with one or more embodiments of the present disclosure.

Referring now to FIG. 2, a schematic view of a tool 200 in accordance with one or more embodiments of the present disclosure is shown. The tool 200 may be connected to and/or included within a drill string 202, in which the tool 200 may be disposed within a borehole 204 formed within a subsurface formation F. As such, the tool 200 may be included and used within a bottom hole assembly, as described above.

Particularly, in this embodiment, the tool 200 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. As such, the tool 200 may include a probe 210 to hydraulically establish communication with the formation F and draw formation fluid 212 into the tool 200.

In this embodiment, the tool 200 may also include a stabilizer blade 214 and/or one or more pistons 216. As such, the probe 210 may be disposed on the stabilizer blade 214 and extend therefrom to engage the wall of the borehole 204. The pistons, if present, may also extend from the tool 200 to assist probe 210 in engaging with the wall of the borehole 204. In alternative embodiments, though, the probe 210 may not necessarily engage the wall of the borehole 204 when drawing fluid.

As such, fluid 212 drawn into the tool 200 may be measured to determine one or more parameters of the formation F, such as pressure and/or pretest parameters of the formation F. Additionally, the tool 200 may include one or more devices, such as sample chambers or sample bottles provided in the sample carriers 221, that may be used to collect formation fluid samples. These formation fluid samples may be retrieved back at the surface with the tool 200. Alternatively, rather than collecting formation fluid samples, the formation fluid 212 received within the tool 200 may be circulated back out into the formation F and/or borehole 204. As such, a pumping system may be included within the tool 200 to pump the formation fluid 212 circulating within the tool 200. For example, the pumping system may be used to pump formation fluid 212 from the probe 210 to the sample bottles and/or back into the formation F. Alternatively still, in one or more embodiments, rather than collecting formation fluid samples, a tool in accordance with embodiments disclosed herein may be used to collect samples from the formation F, such as one or more coring samples from the wall of the borehole 204.

In the example shown in FIG. 2, the tool 200 and the sample carrier 221, and/or two sample carriers 221 may be fluidly and electrically coupled, for example as shown in U.S. Pat. No. 7,543,659, incorporated herein by reference. An apparatus according to one or more embodiments of the present disclosure may be used to prevent leakage of fluid between the tool 200 and the sample carrier 221, and/or between two sample carriers 221, such as when connecting and disconnecting the tools to and from each other before lowering the tools in the borehole 204 and/or after pulling the tools out of the borehole 204.

Figure 3:
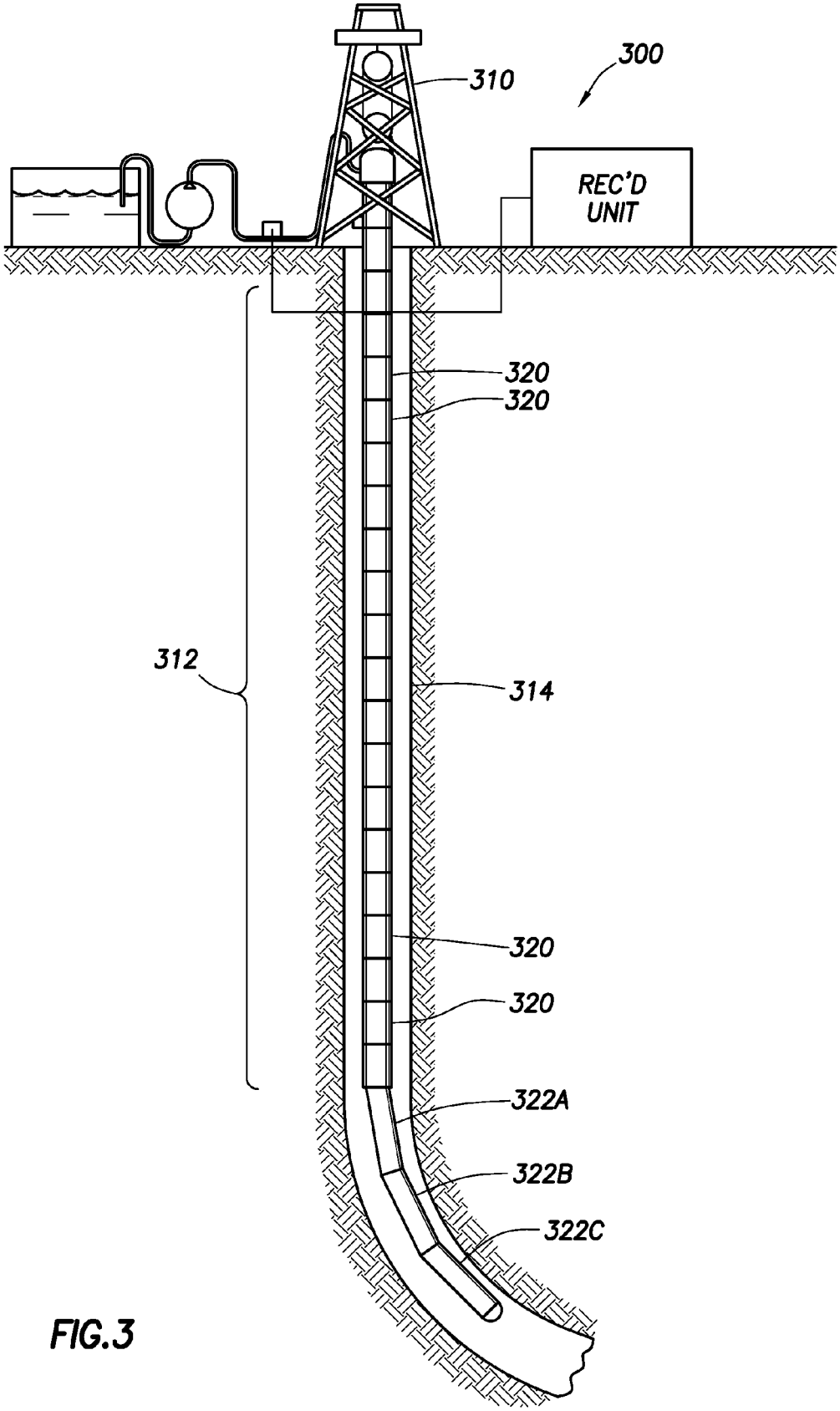
FIG. 3 shows a schematic view of a wellsite having an apparatus in accordance with one or more embodiments of the present disclosure.

Referring now to FIG. 3, a schematic view of a wellsite 300 having a drilling rig 310 in accordance with one or more embodiments of the present disclosure is shown. In this embodiment, a borehole 314 may be formed within a subsurface formation F, such as by using a drilling assembly, or any other method known in the art. Further, in this embodiment, a wired pipe string 312 may be suspended from the drilling rig 310. The wired pipe string 312 may be extended into the borehole 314 by threadably coupling multiple segments 320 (i.e., joints) of wired drill pipe together in an end-to-end fashion. As such, the wired drill pipe segments 320 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. Further, the wired drill pipe may include having a form of signal coupling, such as having inductive coupling, to communicate data and/or signals between adjacent pipe segments assembled together.

As such, the wired pipe string 312 may include one or more tools 322 and/or instruments disposed within the pipe string 312. For example, as shown in FIG. 3, a string of multiple borehole tools 322A, 322B and 322C may be coupled to a lower end of the wired pipe string 312. The tools 322A-322C may include one or more tools used within wireline applications, may include one or more LWD tools, may include one or more formation evaluation or sampling tools, and/or may include any other tools capable of measuring a characteristic of the formation F.

The tools 322A-322C may be connected to the wired pipe string 312 during drilling the borehole 314, or, if desired, the tools 322 may be installed after drilling the borehole 314. If installed after drilling the borehole 314, the wired pipe string 312 may be brought to the surface to install the tools 322A-322C, or, alternatively, the tools 322A-322C may be connected or positioned within the wired pipe string 312 using other methods, such as by pumping or otherwise moving the tools 322A-322C down the wired pipe string 312 while still within the borehole 314. The tools 322 may then be positioned within the borehole 314, as desired, through the selective movement of the wired pipe string 312, in which the tools 322A-322C may gather measurements and data. These measurements and data from the tools 322A-322C may then be transmitted to the surface of the borehole 314 using the cable within the wired drill pipe 312. As such, a pumping system in accordance with embodiments disclosed herein may be included within the wired drill pipe 312, such as by including the pumping system within one or more of the tools 322A-322C of the wired drill pipe 312 for activation and/or measurement purposes.

In the example shown in FIG. 3, the tool 322A-322C may be fluidly and electrically coupled. An apparatus according to one or more embodiments of the present disclosure may be used to prevent leakage of fluid between the tools 322A and 322B, and/or between the tools 322B and 322C, such as when connecting and disconnecting the tools to and from each other before lowering the tools in the borehole 314 and/or after pulling the tools out of the borehole 314.

Figure 4:
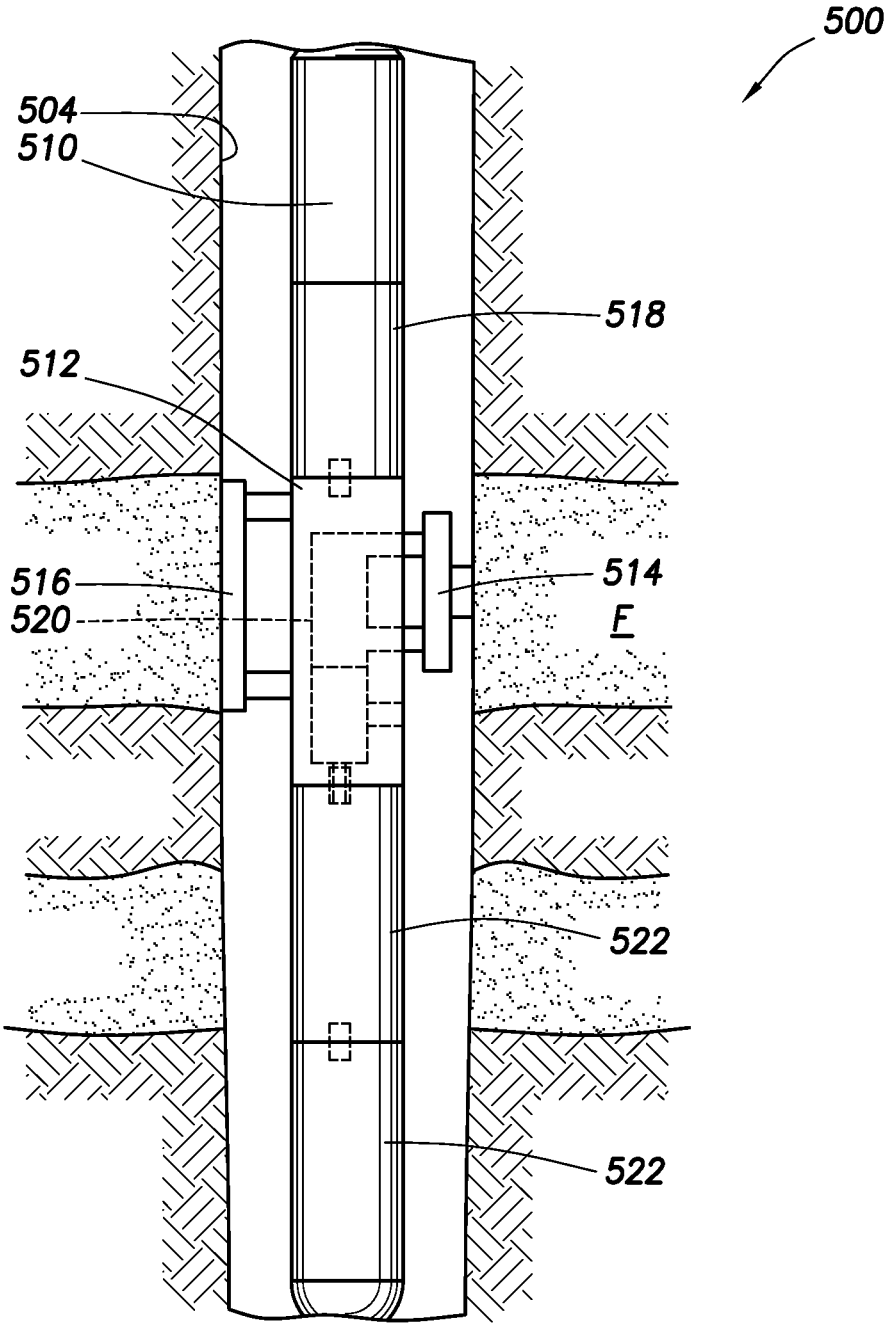
FIG. 4 shows a schematic view of borehole having an apparatus in accordance with one or more embodiments of the present disclosure.

Referring now to FIG. 4, a schematic view of a tool 500 in accordance with one or more embodiments of the present disclosure is shown. In this embodiment, the tool 500 may be suspended within a borehole 504 formed within a subsurface formation F. As such, the tool 500 may be suspended from an end of a wired pipe string, a multi-conductor cable, among other conveyance means.

The tool 500 shown in this embodiment may have an elongated body 510 that includes a formation tester 512 disposed therein. The formation tester 512 may include an extendable probe 514 and an extendable anchoring member 516, in which the probe 514 and anchoring member 516 may be disposed on opposite sides of the body 510. One or more other components 518, such as a measuring device, may also be included within the tool 500.

The probe 514 may be included within the tool 500 such that the probe 514 may be able to extend from the body 510 and then selectively seal off and/or isolate selected portions of the wall of the borehole 504. This may enable the probe 514 to establish pressure and/or fluid communication with the formation F to draw fluid samples from the formation F. The tool 500 may also include a fluid analysis tester 520 that is in fluid communication with the probe 514, thereby enabling the fluid analysis tester 520 to measure one or more properties of the fluid. The fluid from the probe 514 may also be sent to one or more sample chambers or bottles 522, which may receive and retain fluids obtained from the formation F for subsequent testing after being received at the surface. The fluid from the probe 514 may also be sent back out into the borehole 504 or formation F. As such, a pumping system may be included within the tool 500 to pump the formation fluid circulating within the tool 500. For example, the pumping system may be used to pump formation fluid from the probe 514 to the sample bottles 522 and/or back into the formation F.

The tool 500 may also include a hydraulic power module 518 including an electric motor, a hydraulic pump, and a hydraulic fluid reservoir. To energize hydraulic powered devices, such as the extendable probe 514, the anchoring member 516, and/or the pumping system configured to pump formation fluid, hydraulic fluid may be pressurized in the module 518 and then be communicated to the hydraulic powered devices in a tool 500.

While not shown in FIG. 4, the tool 500 may include one or more packers provided with packer modules that may be configured to inflate, thereby selectively sealing off a portion of the borehole 504. Further, to test the formation F, the tool 500 may also include one or more outlets that may be used to draw and/or inject fluids within the sealed portion established by the packers between the tool 500 and the formation F. As such, the pumping system included within the tool 500 to pump formation fluid circulating within the tool 500 may also be used to selectively inflate and/or deflate the packers, in addition to pumping fluid out of the outlet into the sealed portion formed by the packers.

In the example shown in FIG. 4, the formation tester 512, the hydraulic power module 518, and/or the sample bottles 522 may be fluidly and electrically coupled, among other modules that may be used in the tool 500. An apparatus according to one or more embodiments of the present disclosure may be used to prevent leakage of fluid between the formation tester 512 and the hydraulic power module 518, between the formation tester 512 and the sample bottle 522, and/or between the sample bottles 522, such as when connecting and disconnecting the tools to and from each other before lowering the tools in the borehole 504 and/or after pulling the tools out of the borehole 504.

Figure 5:
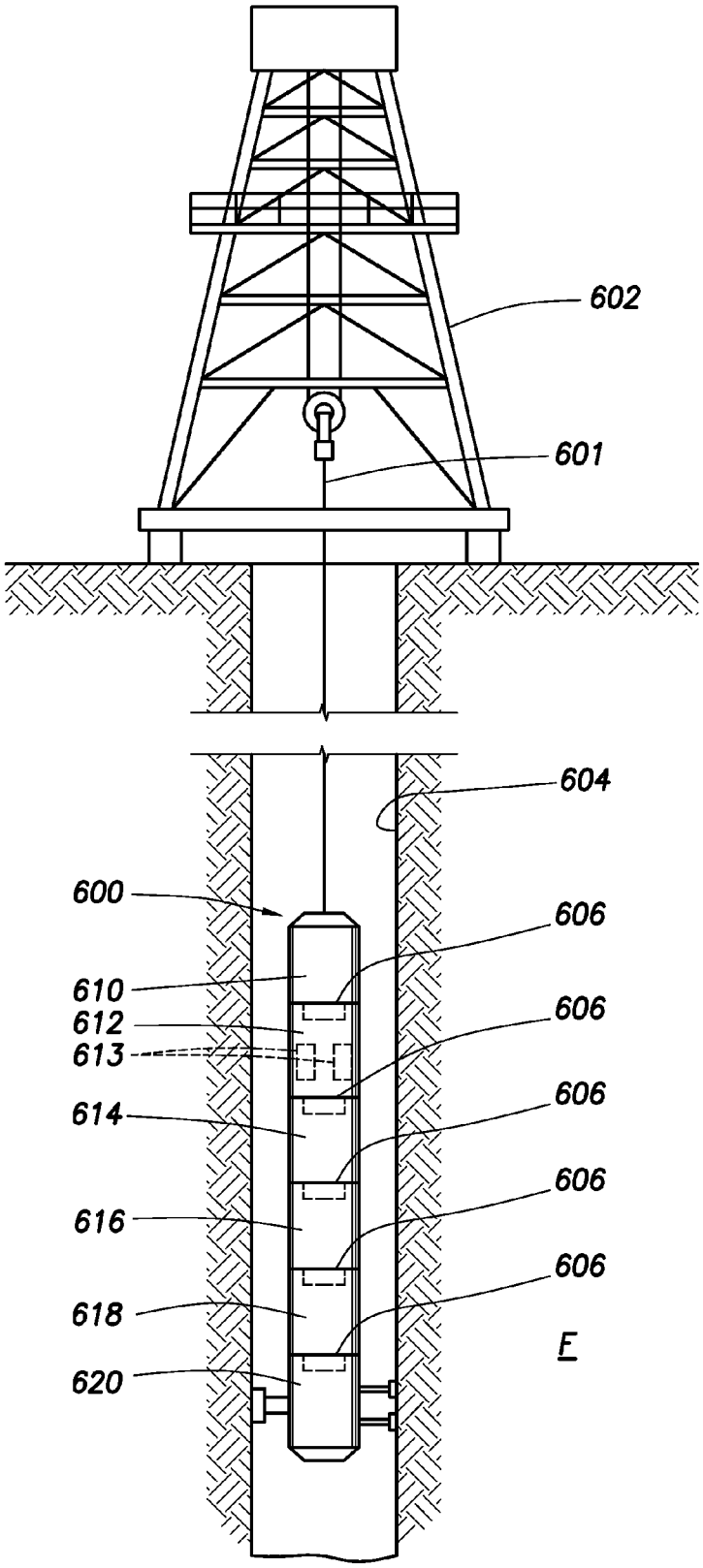
FIG. 5 shows a schematic view of a wellsite having an apparatus in accordance with one or more embodiments of the present disclosure.

Referring now to FIG. 5, a schematic view of another tool 600 in accordance with one or more embodiments of the present disclosure is shown. The tool 600 may be deployed from a rig 602 into a borehole 604 traversing a reservoir or geological formation F. Alternatively, the tool 600 may be directly deployed from a truck without utilizing a rig 602. The tool 600 may be lowered into the borehole 604 using the wireline cable 606. The multi-conductor cable 606 may couple the tool 600 with an electronics and processing system (not shown) disposed on the surface.

In this embodiment, the tool 600 may include several modules connected to each other, such as connected by one or more field joints 606 that may have similar size restrictions as the tool 600. In the illustrated embodiment, the tool 600 may include an electronics module 610, a sample storage module 612 having one or more sample chambers 613, a first pump out module 614, a second pump out module 616, a hydraulic module 618, and/or a probe module 620. The wireline tool 600 may include any number of modules, including less than and more than the size modules shown in the illustrated embodiment, may incorporate different types of modules performing different functions than those shown and/or described above. The field joints 606 may be provided between adjacent modules for connecting the fluid and electrical lines extending through the tool 600.

In the example shown in FIG. 5, the field joints 606 may be used to fluidly and electrically couple the modules 610, 612, 613, 614, 616, 618, and/or 620. An apparatus according to one or more embodiments of the present disclosure may be used to prevent leakage of fluid, such as when connecting and disconnecting the tools to and from each other via the field joints 606, for example before lowering the tools in the borehole 604 and/or after pulling the tools out of the borehole 604.

Figure 6B:
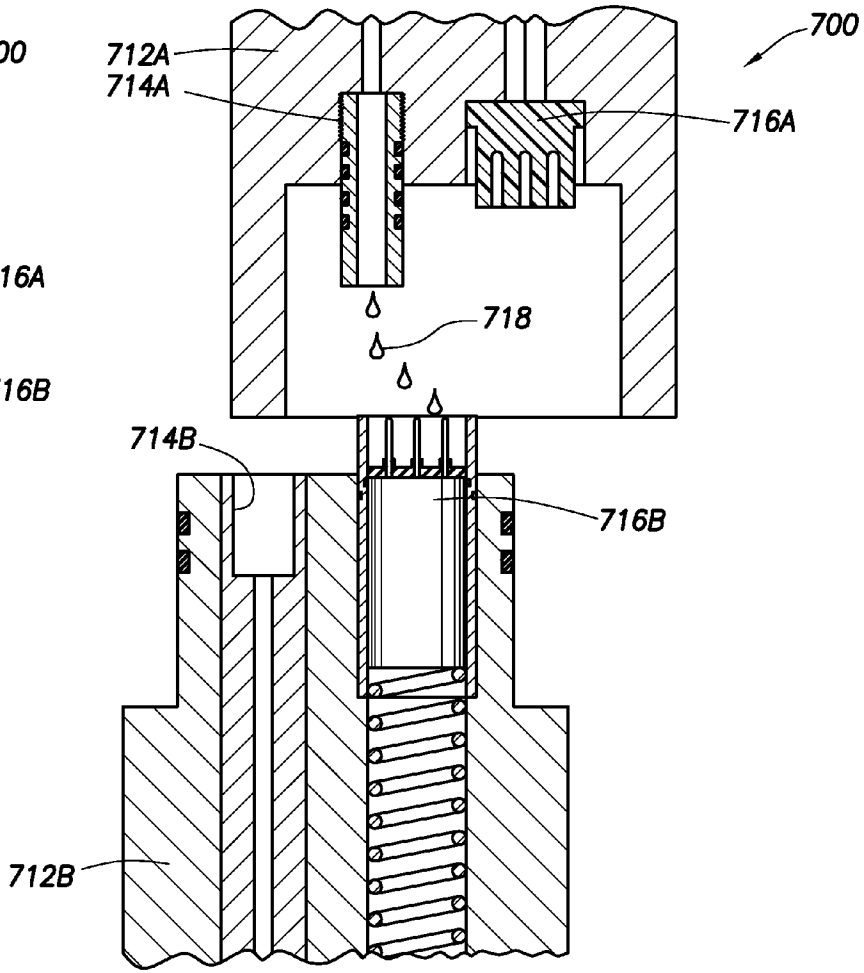
FIG. 6B (PRIOR ART)
FIGS. 6A-6B show multiple views of a downhole tool.
Figure 6A:
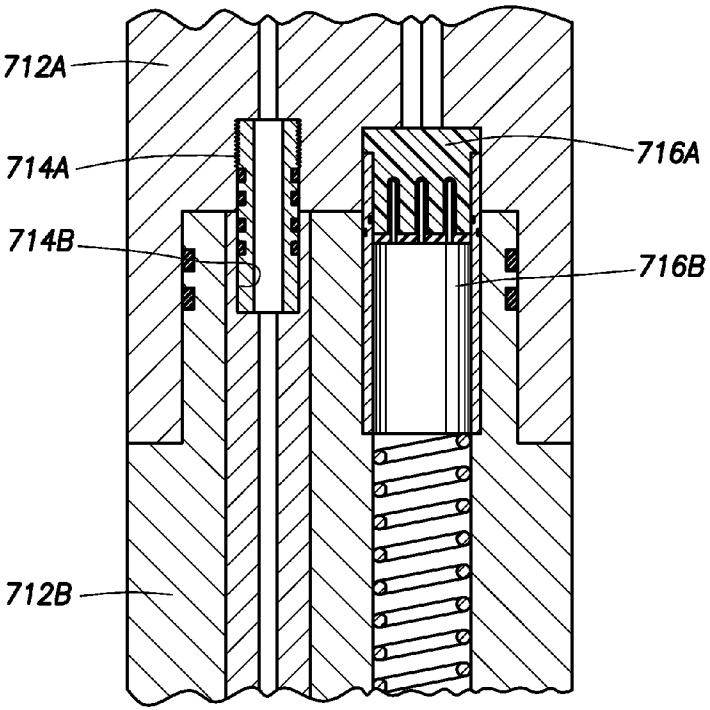
FIG. 6A (PRIOR ART)

Referring now to FIGS. 6A-6B, multiple side views of a downhole tool 700 are shown. For example, the tool 700 may be a wireline tool, in which the tool 700 may have a multi-conductor cable (not shown) attached to an end thereof for conveyance in the wellbore.

As shown, the tool 700 may include multiple modules, such as modules 712A and 712B, in which the modules 712A-B may be connected to each other. Particularly, the modules 712A-B may be connected to each other such that the modules 712A-B may establish hydraulic and/or electrical connections therebetween. For example, the modules 712A-B may be connected to each other and disconnected from each other, such as by threadingly engaging and disengaging the modules 712A-B to and from each other, thereby enabling the modules 712A-B to couple to each other and form the tool 700. As each of the modules 712 are connected and disconnected, the modules 712 may form hydraulic and/or electrical connections to establish hydraulic and/or electrical communication therebetween. As such, a known hydraulic connector 714A-B and a known electrical connector 716A-B may be disposed between the modules 712A-B, such as by having a flowline stabber to hydraulically connect the modules 712A-B, and/or by having male and female components of an electric connector disposed between the modules 712A-B. Particularly, the hydraulic connector 714A-B may be used to fluidly couple the flow lines of the modules 712A-B together, such as by having a flow line from the module 712A fluidly coupled to a flow line from the module 712B by use of the hydraulic connector 714. The hydraulic connector 714 may be a field joint, for example, as the components of a field joint may be coupled together within the field onsite of a oil rig, as compared to coupling the components of a connector together offsite, such as during manufacturing. Accordingly, FIG. 6A shows the tool 700 assembled, and FIG. 6B shows the tool 700 partially disassembled (with module 712A being disconnected from module 712B).

As each of the modules 712A-B may perform different functions, such as electrical power supply, hydraulic power supply, fluid sampling, fluid analysis, and sample collection, the modules 712A-B may draw fluid therein for testing and/or sampling, and/or fluid may be transferred between the modules 712A-B, such as when fluid is pumped between modules 712A-B. As such, after use, the tool 700 may have fluid residing within one or more of the modules 712A-B. When the modules 712A-B are disconnected from each other, fluid then still residing inside one or both of the modules 712A-B may then leak therefrom. For example, as shown in FIG. 6B, fluid 718 that was inside of the module 712A may leak from the known hydraulic connector 714A over the end faces of the modules 712B.

As such, electrical components, particularly of the electrical connectors 716B, may become exposed and contaminated by the fluid 718, as the fluid 718 may range from water to drilling mud, thereby impairing the ability of the electrical connectors 716A to conduct electricity. The electrical damage and shortening to the connectors 716A usually require the tool 700 to be properly repaired, thereby possibly costing valuable time and money when performing oilfield exploration.

An apparatus in accordance with the present disclosure may be included within one or more of the embodiments shown in FIGS. 1-6, in addition to being included within other tools and/or devices that may be disposed downhole within a formation. The apparatus, thus, may be used within a downhole tool to prevent leakage of a fluid within the downhole tool. For example, as shown with respect to the above figures, and particularly in FIG. 6B, leakage may occur within a downhole tool, such as when connecting and disconnecting modules or components of the tool. As such, an apparatus in accordance with embodiments disclosed herein may be used to hydraulically (e.g., fluidly) connect modules of the tool together such that, when the modules of the tool are being disconnected from each other, the apparatus may substantially prevent fluid from leaking between the two modules. Particularly, the apparatus may be able to provide a seal therein that prevents fluid from leaking therefrom when the modules are disengaged from each other.

Thus, in accordance with the present disclosure, embodiments disclosed herein generally relate to an apparatus that may be used within a downhole tool, in addition to being included within one or more the embodiments shown in FIGS. 1-6, in addition to being included within other tools and/or devices that may be disposed downhole. The apparatus may be used, for example, when two modules within a downhole tool are connected to each other, such as by having the modules hydraulically coupled to each other. Further, the apparatus may be used when the modules are also electrically coupled to each other. As such, the apparatus may be able to be used as a hydraulic connector to facilitate hydraulic communication between the modules, in addition to preventing fluid from leaking when disconnecting the modules from each other.

An apparatus in accordance with embodiments disclosed herein may include a first body portion and a second body portion. The first body portion and the second body portion may both include a fluid flow path formed therethrough, thereby enabling fluid to flow through the first body portion into and through second body portion. Further, the first body portion and the second body portion may be movable with respect to each other. For example, the first body portion and the second body portion may be able to move between a first position and a second position with respect to each other.

The apparatus may further include a stopper, in which the stopper may be connected to the second body portion. As such, in one embodiment, to have the stopper connected to the second body portion, the stopper may be connected to a stem, in which the stem may be connected to the second body portion. Further, the stopper may be disposed within the first body portion of the apparatus. As the stopper may be connected to the second body portion, the stopper may also be movable with respect to the first body portion. For example, as the first body portion and the second body portion may be able to move between the first position and the second position with respect to each other, the stopper and the first body portion may be able to move between a first position and a second position with respect to the each other. Accordingly, in one embodiment, the stopper may be used to sealingly engage against and sealingly disengage from the first body portion as the first body portion and the second body portion move with respect to each other, such as the when the first body portion and the second body portion move between the first position and the second position with respect to each other.

Further, the first body portion and the second body portion of the apparatus may be biased away from each other. For example, a biasing mechanism may be disposed between the first body portion and the second body portion such that the first body portion and the second body portion are biased away from each other. In such an embodiment, the first body portion and the second body portion may be biased from the second position towards the first position with respect to each other.

Figure 7C:
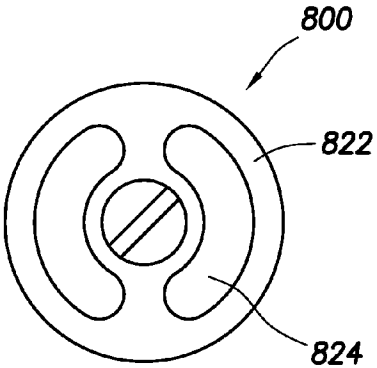
FIGS. 7A-7C show multiple views of an apparatus in accordance with one or more embodiments of the present disclosure.
Figure 7B:
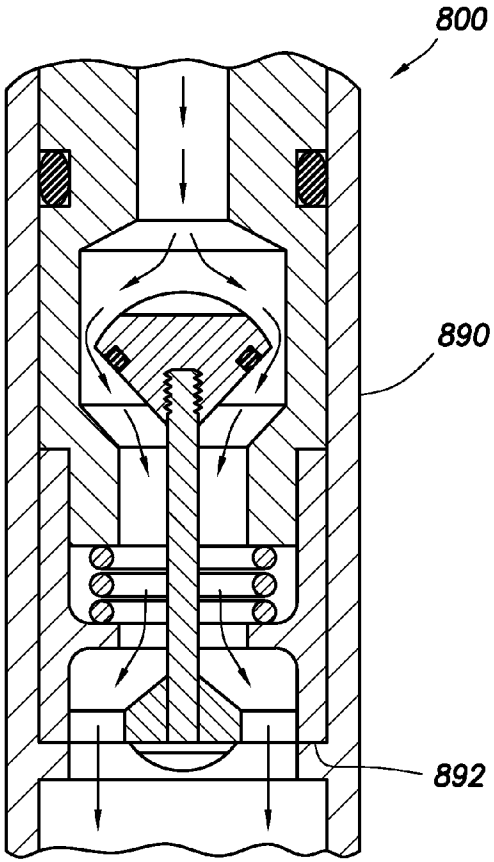
Figure 7A:
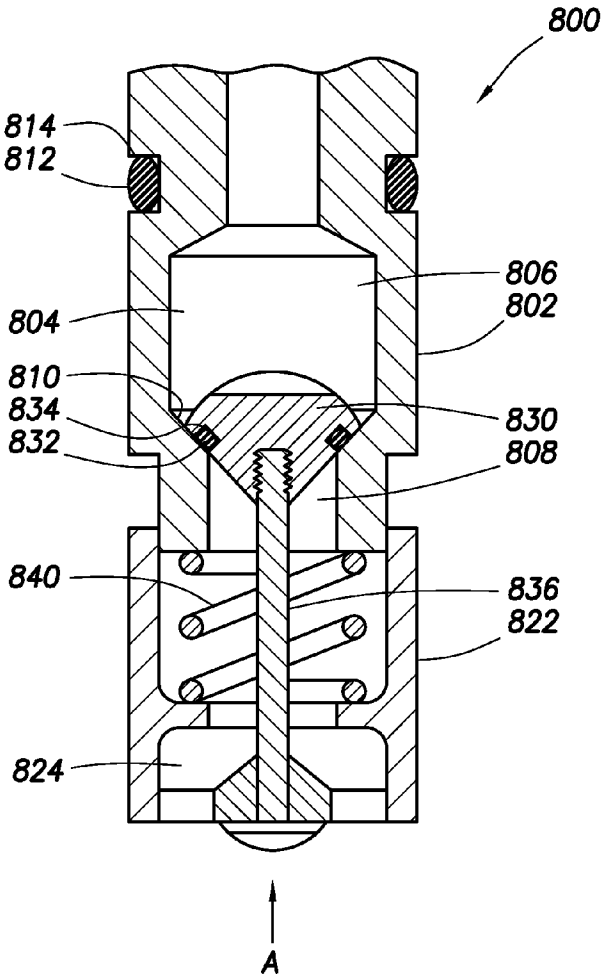

Referring now to FIGS. 7A-7C, multiple views of an apparatus 800 in accordance with one or more embodiments disclosed herein are shown. For example, the apparatus 800 may be used to replace the known hydraulic connector 714 shown in FIGS. 6A-6C. FIG. 7A shows a sectional view of the apparatus 800 in a first position, FIG. 7B shows a sectional view of the apparatus 800 in a second position, and FIG. 7C shows a view of the apparatus 800 along direction A in FIG. 7A.

The apparatus 800 may include a first body portion 802 and a second body portion 822. The first body portion 802 may have a fluid flow path 804 formed therethrough, and the second body portion 822 may have a fluid flow path 824 formed therethrough. As such, the first body portion 802 and the second body portion 822 may be disposed adjacent to each other such that the fluid flow path 804 of the first body portion 802 and the fluid flow path 824 of the second body portion 822 may be in alignment with each other. For example, as the fluid flow paths 804 and 824 may be in alignment with each other, fluid may be able to flow through the apparatus 800 by flowing through the fluid flow paths 804 and 824 of the first body portion 802 and the second body portion 822. Further, the fluid may flow and exit from the second body portion 822, such as through the end of the fluid flow path 824 shown in FIG. 7C.

Further, the first body portion 802 and the second body portion 822 may be movable with respect to each other. For example, the first body portion 802 and the second body portion 822 may be able to move between a first position (shown in FIG. 7A) and a second position (shown in FIG. 7B) with respect to each other. In the second position, the first body portion 802 and the second body portion 822 may move closer to each other, as compared to the first position, such that one of the first body portion 802 and the second body portion 822 is disposed, at least partially, within the other. For example, in FIG. 7B, the first body portion 802 and the second body portion 822 have moved closer to each other such that the first body portion 802 is disposed, at least partially, within the second body portion 822.

However, those having ordinary skill in the art through will appreciate that the present disclosure is not so limited, as other embodiments are contemplated that may have the second body portion disposed, at least partially, within the first body portion when the body portions move with respect to each other. Alternatively, other embodiments are contemplated such that, as the first body portion and the second body portion move with respect to each other, neither of the body portions are disposed within the other, though fluid may be able to flow therebetween (such as by having a fluid sleeve coupling the body portions together).

The apparatus 800 may also include a stopper 830, in which the stopper 830 may be connected to the second body portion 822. For example, in one embodiment, the stopper 830 may be connected to a stem 836, in which the stem 836 may then be connected to the second body portion 822. Thus, the stopper 830 may be connected to the second body portion 822 through the stem 836. Those having ordinary skill in the art, however, will appreciate that the present disclosure is not limited to the shown embodiments for connecting the stopper to the body portions of the apparatus, as other structures and arrangements may be used to connect the stopper to the body portions of the apparatus without departing from the scope of the present disclosure.

Further, as shown, the stopper 830, though connected to the second body portion 822, may be disposed within the first body portion 802. Particularly, the stopper 830 may be disposed within the fluid flow path 804 of the first body portion 802 such that the fluid flowing through the fluid flow path 804 of the first body portion 802 may contact the stopper 830. For example, as shown in FIGS. 7A-7C, the fluid flow path 804 of the first body portion 802 may include a section 806 having a larger diameter and a section 808 having a smaller diameter with respect to each other. As such, the stopper 830 may have a diameter between the diameters of the section 806 and the section 808 such that the stopper 830 may be disposed within the section 806 of the first body portion 802 and be substantially prevented from entering the section 808 of the first body portion 802. Further, in one or more embodiments, the first body portion 802 may have a tapered surface 810 formed therein, such as to provide a transition between the section 806 and the section 808. In such embodiments, the stopper 830 may engage the tapered surface 810 when disposed within the first body portion 802.

Referring still to FIGS. 7A-7C, as the stopper 830 may be connected to the second body portion 822, the stopper 830 may be able to move with respect to the first body portion 802, similar to the second body portion 822. For example, as the first body portion 802 and the second body portion 822 may be able to move between the first position (in FIG. 7A) and the second position (in FIG. 7B) with respect to each other, the stopper 830 and the first body portion 802 may be able to move between a first position (in FIG. 7A) and a second position (in FIG. 7B) with respect to each other.

As such, as the stopper 830 and the first body portion 802 move with respect to each other, the stopper 830 may be used to sealingly engage against and sealingly disengage from the first body portion 802. For example, in the first position, shown in FIG. 7A, the stopper 830 may sealingly engage the first body portion 802, such as to use the stopper 830 to prevent fluid flow through the fluid flow path 804 of the first body portion 802. Further, in the second position, shown in FIG. 7B, the stopper 830 may sealingly disengage from the first body portion 802, such as to enable fluid flow through the fluid flow path 804 of the first body portion 802. The flow of the fluid through the fluid flow path 804 of the first body portion 802 and the fluid flow path 824 of the second body portion 824 is shown in FIG. 8B. As such, in accordance with one or more embodiments, the stopper 830 may be used to sealingly engage against the tapered surface 810, if present, of the fluid flow path 804 within the first body portion 802.

Further, the first body portion 802 and the second body portion 822 of the apparatus 800 may be biased away from each other. In one embodiment, the apparatus 800 may include a biasing mechanism 840, such as by having the biasing mechanism 840 disposed within the apparatus 800 to bias the first body portion 802 and the second body portion 822 away from each other. For example, as shown in FIGS. 7A and 7B, the biasing mechanism 840 may be disposed between the first body portion 802 and the second body portion 822 such that the first body portion 802 and the second body portion 822 are biased away from each other. In such an embodiment, the first body portion 802 and the second body portion 822 may be biased from the second position towards the first position with respect to each other. Thus, though a force may be used to overcome the force of the biasing mechanism to move the first body portion 802 and the second body portion 822 from the first position towards the second position with respect to each other, the biasing mechanism 840 (e.g., a spring) may be used to produce a force to bias the first body portion 802 and the second body portion 822 from the second position towards the first position with respect to each other, such as when no other substantial force acts against the biasing force of the biasing mechanism 840.

To facilitate the sealing by the apparatus 800, the apparatus 800 may include one or more seals. As such, the stopper 830 may include a seal 832, such as by having the seal 832 disposed within a groove 834 formed within the stopper 830. Accordingly, the seal 832 may be used to sealingly engage the first body portion 802, such as by, in one embodiment, sealingly engaging the tapered surface 810 of the first body portion 802. Further, the first body portion 802 may have a seal 812, such as by having the seal 812 disposed within a groove 814 formed within the first body portion 802. The seal 812 may be used to sealingly engage the first body portion 802 with another body, such as the inner surface of a flow line or flow conduit of a downhole tool (discussed more below). Alternatively, or additionally, the seals may be attached to surfaces of the apparatus, rather than disposing the seals within grooves formed within the apparatus. Further, the seals may be disposed in alternative or additional locations, as compared to those shown in FIGS. 7A-7C. Furthermore, the seals may be o-rings, as shown, or may be any other sealing element or material that is known in the art to provide sealing engagement with the apparatus of the present disclosure.

Accordingly, in one or more embodiments, the apparatus 800 may be used to prevent the leakage of fluid between modules of a downhole tool. For example, the apparatus 800 may be disposed, at least partially, within a flow line or flow conduit 890 of a tool module, in which the flow line or flow conduit 890 may have a projecting surface 892. The projecting surface 892 may be formed such that, when the apparatus 800 is disposed within the flow line or flow conduit 890, the projecting surface 892 may engage the second body portion 822 of the apparatus 800. As the apparatus 800 is disposed within the flow line or flow conduit 890, the apparatus 800 may move from the first position (in FIG. 7A) to the second position (in FIG. 7B) to thereby enable fluid flow through the apparatus 800. Accordingly, in one embodiment, if the apparatus 800 is disposed between multiple modules of a downhole tool, the modules may be connected to each other when the apparatus is in the second position, thereby enabling the apparatus 800 to remain in the second position and have fluid flow therethrough when the modules are connected to each other.

In such an embodiment, when disconnecting the modules of the tool from each other, and the modules are pulled apart from each other, the apparatus 800 may be removed from within flow line or flow conduit, such as by removing the apparatus 800 from the flow line or flow conduit 890. As the apparatus 800 is removed from the flow line or flow conduit 890, the apparatus 800 may move from the second position to the first position to thereby prevent fluid flow through the apparatus 800. As such, the apparatus 800 may prevent fluid from leaking from the apparatus 800 (and any module or tool fluidly connected to the apparatus), thereby preventing fluid from leaking onto other components, such as electrical components, of other adjacent modules. For example, as shown in FIG. 6B, the hydraulic connector 714A-B, when disconnected, may leak fluid 718 upon the electrical connector 716B disposed within the module 712B, thereby damaging the electrical connector 716B. The apparatus of the present disclosure, though, may be able to be used as a hydraulic connector to facilitate hydraulic communication between adjacent modules, such as the modules 712A-B, in which the apparatus may be used to prevent fluid from leaking when disconnecting the modules from each other. Accordingly, in accordance with one or more embodiments of the present disclosure, the apparatus may be used as a field joint, for example, in which the field joint may be used to fluidly couple the flow lines of adjacent modules to each other, such as by using an apparatus in accordance with the present disclosure to fluidly couple a flow line from the module 712A to a flow line from the module 712B.

Embodiments disclosed herein may provide for one or more of the following advantages. An apparatus in accordance with the present disclosure may be included within one or more of the embodiments shown in FIGS. 1-6, in addition to being included within other tools and/or devices that may be disposed downhole within a formation. The apparatus, thus, may be used within a tool to prevent leakage of fluid within the tool. For example, the apparatus may be used to prevent leakage between modules of the tool, such as when connecting and disconnecting the modules of the tool to and from each other. Further, the apparatus may be used to increase fluid flow therethrough, as the apparatus may have an increased flow area therethrough, as compared to other sealing apparatus.

In accordance with one aspect of the present disclosure, one or more embodiments disclosed herein relate to an apparatus to prevent leakage within a tool. The apparatus includes a first body portion having a first fluid flow path formed therethrough and a second body portion having a second fluid flow path formed therethrough. The second body portion is movable between a first position and a second position with respect to the first body portion. The apparatus further includes a stopper connected to the second body portion and disposed within the first body portion. When the second body portion is in the first position, the stopper sealingly engages the first fluid flow path, and when the second body portion is in the second position, the stopper sealingly disengages from the first fluid flow path.

In accordance with another aspect of the present disclosure, one or more embodiments disclosed herein relate to a method to hydraulically seal a downhole tool. The method includes disposing a first body portion with a first fluid flow path and a second body portion with a second fluid flow path within a flow line of the downhole tool, in which the first body portion and the second body portion are movable between a first position and a second position with respect to each other. The method further includes connecting a stopper to the second body portion such that, when the first body portion and the second body portion are disposed in the first position with respect to each other, the stopper sealingly engages the first fluid flow path of the first body portion, and when the first body portion and the second body portion are disposed in the second position with respect to each other, the stopper sealingly disengages from the first fluid flow path of the first body portion.

In accordance with another aspect of the present disclosure, one or more embodiments disclosed herein relate to a hydraulic connector. The connector includes a first body portion and a second body portion in fluid communication with each other, wherein the first body portion and the second body portion are configured to move with respect to each other, and further includes a stopper connected to the second body portion and disposed within the first body portion. The stopper is configured to sealingly engage against and sealingly disengage from the first body portion as the first body portion and the second body portion move with respect to each other.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool configured to be conveyed within a wellbore extending into a subterranean formation, wherein the downhole tool comprises a flowline connector comprising:

a first body portion having a first fluid flow path;

a second body portion having a second fluid flow path, wherein the second body portion is movable between a first position and a second position with respect to the first body portion, wherein when the second body portion is in the second position, the first body portion is disposed within the second body portion; and a stopper coupled to the second body portion and disposed within the first body portion and outside of the second body portion, wherein the stopper sealingly engages the first fluid flow path when the second body portion is in the first position, and wherein the stopper sealingly disengages from the first fluid flow path when the second body portion is in the second position.

2. The apparatus of claim 1 wherein, when the second body portion is in the second position, the first fluid flow path of the first body portion is aligned with the second fluid flow path of the second body portion.

3. The apparatus of claim 1 further comprising a stem coupled to the second body portion, wherein the stopper is coupled to the second body portion via the stem, and wherein the stem extends through an end of the first body portion into the second body portion.

4. The apparatus of claim 1 wherein the stopper comprises a seal configured to sealingly engage the first fluid flow path of the first body portion.

5. The apparatus of claim 1 wherein the first body portion comprises a seal disposed thereabout.

6. The apparatus of claim 1 further comprising a biasing member disposed within the second body portion and abutting an end of the first body portion, and configured to bias the second body portion away from the first body portion and towards the first position.

7. The apparatus of claim 1 wherein the first fluid flow path of the first body portion comprises a tapered surface, wherein the stopper sealingly engages against the tapered surface of the first fluid flow path of the first body portion.

8. The apparatus of claim 1 wherein the first fluid flow path of the first body portion comprises a first section having a larger diameter than a second section, and wherein the stopper is at least partially disposed within the first section of the first fluid flow path.

9. The apparatus of claim 1 further comprising:

a stem coupled to the second body portion, wherein the stopper is coupled to the second body portion via the stem; and a biasing member disposed between the first body portion and the second body portion and configured to bias the second body portion away from the first body portion and towards the first position; wherein:

the first fluid flow path of the first body portion is aligned with the second fluid flow path of the second body portion when the second body portion is in the second position;

the first body portion is disposed within the second body portion when the second body portion is in the second position;

the stopper comprises a first seal configured to sealingly engage the first fluid flow path of the first body portion;

the first body portion comprises a second seal disposed thereabout;

the first fluid flow path of the first body section comprises a tapered surface against which the stopper sealingly engages;

the first fluid flow path of the first body portion comprises a first section having a larger diameter than a second section; and the stopper is at least partially disposed within the first section of the first fluid flow path.

10. A method, comprising:

disposing a first body portion and a second body portion within a flow line of a downhole tool, wherein the first body portion comprises a first fluid flow path, wherein the second body portion comprises a second fluid flow path, wherein the first body portion and the second body portion are movable between a first position and a second position with respect to each other, and wherein the downhole tool is configured for conveyance within a wellbore extending into a subterranean formation;

disposing a biasing member within the second body portion and abutting an end of the first body portion to bias the second body portion away from the first body portion and into the first position; and connecting a stopper to the second body portion such that the stopper is disposed within the first body portion and outside of the second body portion, the stopper sealingly engages the first fluid flow path of the first body portion when the first body portion and the second body portion are disposed in the first position with respect to each other, and the stopper sealingly disengages from the first fluid flow path of the first body portion when the first body portion and the second body portion are disposed in the second position with respect to each other.

11. The method of claim 10 wherein the first fluid flow path of the first body portion is aligned with the second fluid flow path of the second body portion when the first body portion and the second body portion are disposed in the second position with respect to each other.

12. The method of claim 10 wherein connecting the stopper to the second body portion comprises connecting the stopper to a stem and connecting the stem to the second body portion.

13. The method of claim 10 further comprising disposing a seal about the stopper such that the seal sealingly engages the first flow path within the first body portion.

14. The method of claim 10 further comprising forming a tapered surface within the first fluid flow path of the first body section, wherein the stopper is configured to sealingly engage against the tapered surface of the first fluid flow path within the first body portion.

* * * * *